US005478054A

United States Patent [19]

Titze et al.

[11] Patent Number: 5,478,054

[45] Date of Patent: Dec. 26, 1995

[54] DEVICE TEMPERING STEEL TUBES

[75] Inventors: Eberhard E. Titze, Muldensteing, Germany; Paulo F. Alencar, Belo Horizonte, Brazil; Edésio E. D. Louzada, Belo Horizonte, Brazil; Werner F. Dreistein, Belo Horizonte, Brazil

[73] Assignee: Mannesmann, S.A., Minos Gerais, Brazil

[21] Appl. No.: 284,602

[22] PCT Filed: Feb. 12, 1993

[86] PCT No.: PCT/BR93/00005

§ 371 Date: Aug. 11, 1994

§ 102(e) Date: Aug. 11, 1994

[87] PCT Pub. No.: WO93/16202

PCT Pub. Date: Aug. 19, 1993

[30] Foreign Application Priority Data

Feb. 14, 1992 [BR] Brazil ..... 9200504

[51] Int. Cl.[6] ..... C21D 9/08

[52] U.S. Cl. ..... 266/131; 266/132

[58] Field of Search ..... 266/114, 131, 266/132; 148/594, 638, 658, 660

[56] References Cited

U.S. PATENT DOCUMENTS

| | | | |
|---|---|---|---|
| 3,997,375 | 12/1976 | Franceschina et al. | 148/594 |
| 4,032,369 | 6/1977 | Jatczak et al. | 148/594 |
| 4,417,928 | 11/1983 | Heine, Jr. et al. | 266/114 |

*Primary Examiner*—Scott Kastler

*Attorney, Agent, or Firm*—Beveridge, DeGrandi, Weilacher & Young

[57] ABSTRACT

A device for tempering steel tubes comprising an immersion tank (6) for cooling fluid, a chassi (2) for horizontally supporting the tube (5) to be tempered in the tank (6), means for displacing the chassi (2) from a suspended position over the tank to a second position in which the tube is inside the tank, means (3*i*, 4*i*) for maintaining the tube on the chassi so that it does not float and a cooling fluid injection nozzle (1) abuttable against an end of the tube (5) for injecting the cooling fluid into the tube. The invention provides an injection nozzle support actuable (9) for coupling the nozzle (1) to the end of the tube (5) in the suspended position and allowing it to accompany the tube to the second position.

7 Claims, 5 Drawing Sheets

FIG. 5
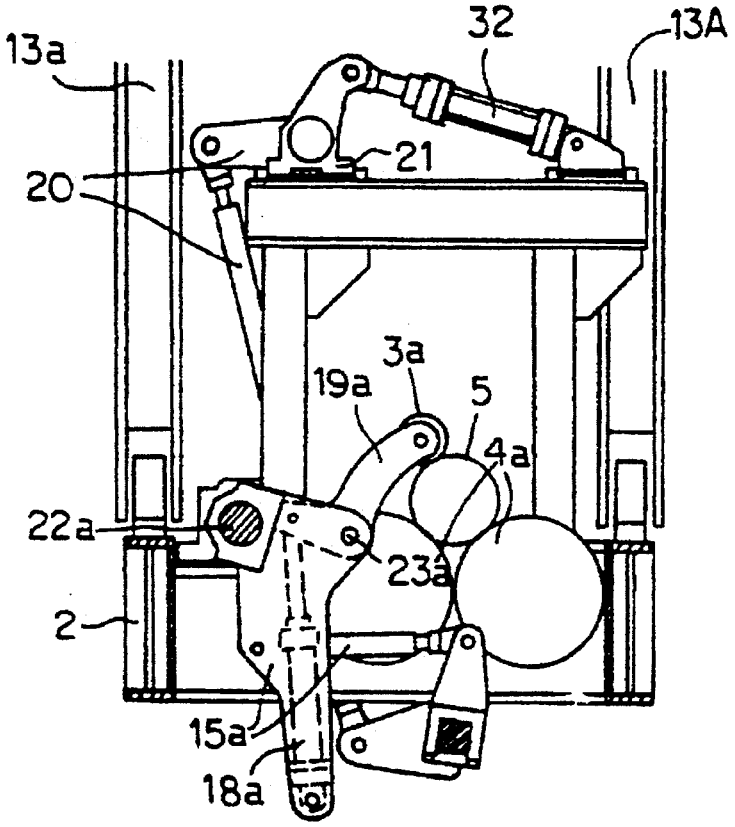
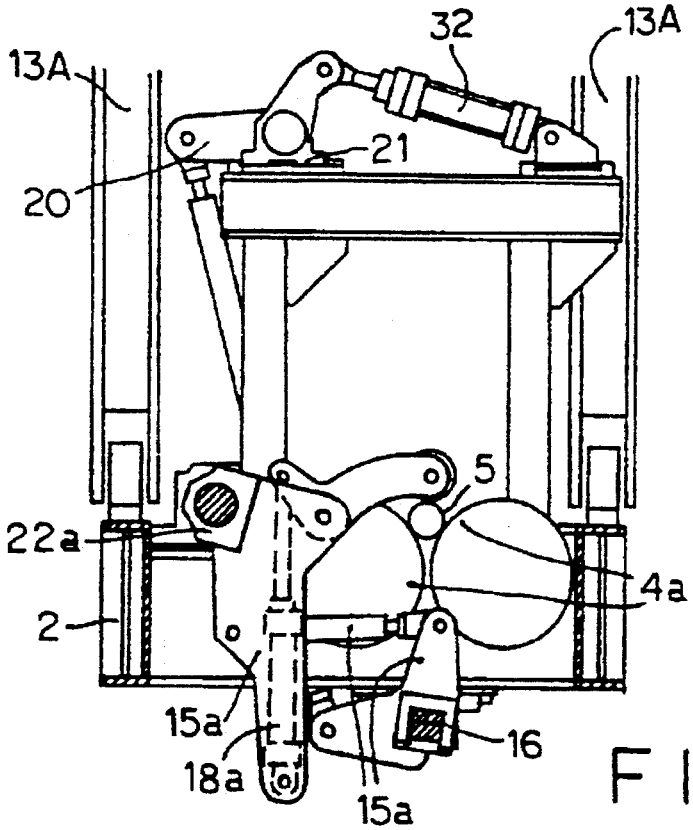
FIG. 6

FIG. 7
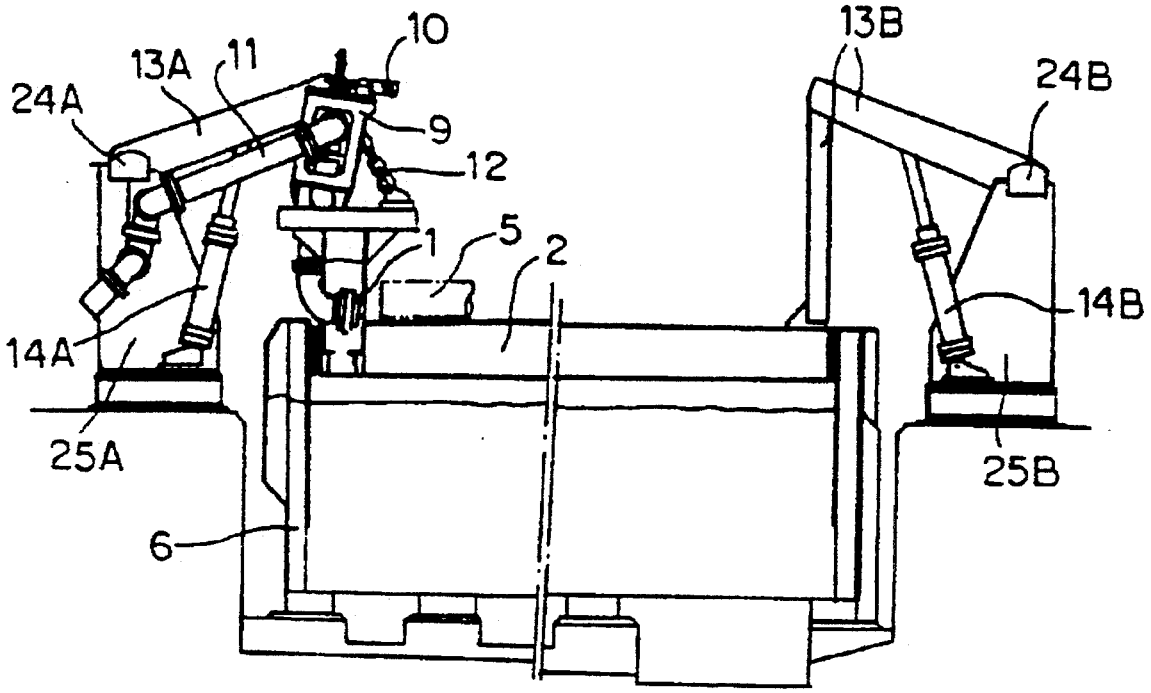
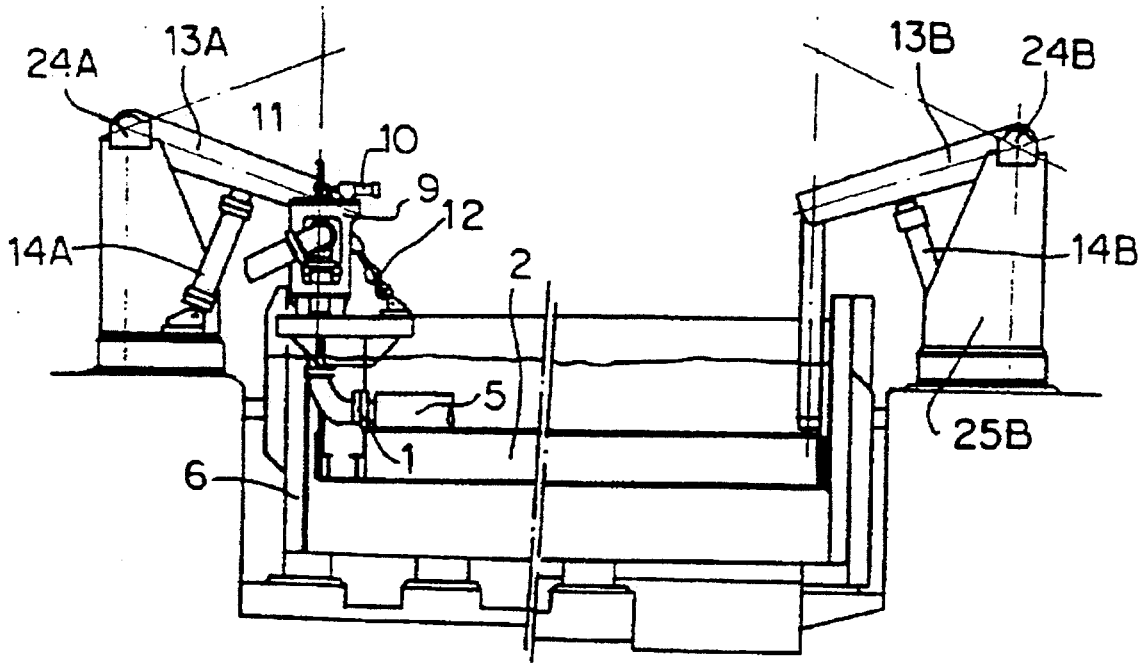
FIG. 8

DEVICE TEMPERING STEEL TUBES

The present invention refers to tempering steel tubes, which are cooled at a high speed by contact with a cooling fluid. More specifically, an injection nozzle is used for cooling from the inner surface of the steel tube, which is dipped into a tank containing a cooling fluid, for cooling it also from its outer surface.

In recent years a continuous search for petroleum reserves has been effected, especially in deep regions of the sea and oceans. With a view to meeting the new requirements for the quality of the steel tubes designed for prospection and production conditions in these oil fields, methods and equipment have been developed for heat treatment of the steel tubes employed therein. Most of the tubes to be tempered seek to meet the requirements of the API (American Petroleum Institute) standards. For certain degrees of quality, these standards require the use of a temper system in the process of manufacturing steel tubes, among such the following can be cited: C75, C90, C95, L80, N80, P105, P110, and Q105. Among these standards can be cited API 5 CT (SPEC 5 TC) which refers to Casing and Tubing type pipes designed for oil well linings and production, and API 5 D referring to Drill Pipe type tubes, directed for drilling oil wells.

At present there are different methods and devices for tempering steel tubes by means of internal and/or external cooling, by employing water, air and oil as a cooling fluid, among others.

Among the principal methods for cooling steel tubes the following can be cited:

1—external cooling by means of tings having nozzles around the tube;

2—cooling by dipping the tubes into a tank containing a cooling medium;

3—internal and external cooling by dipping the tubes into a tank containing a cooling fluid and having an injection nozzle installed inside the cooling-fluid tank, by rotating the steel tube during the process;

4—internal and external cooling by dipping and employing an injection nozzle in accordance with the teachings of European patent No. EP 0086988 to Kruppeft Enterprises Inc.;

5—internal cooling by means of an injection nozzle and external cooling by means of a water curtain upon and along the tube, in accordance with the teachings of DE Pat 3216496 A1;

6—internal and external cooling by dipping and employing a replaceable injection nozzle matched with the size of the tube in accordance with the teachings of EP 0 172 250.

In the case of cooling steel tubes having a thick wall according to method (1) it is impossible to obtain cooling speeds that guarantees temper of the whole wall thickness. Since it is impossible to obtain a 100% even distribution of the cooling fluid on the whole surface of the steel tube, due to the position of one ring around it and to the distribution of the nozzles on the rings, which lead the cooling fluid to the outer surface of the steel tube, the cooling speeds are variable along the outer surface of the tube, thus causing the latter to bend, which in turn makes the movement/transport of the steel tube after the temper difficult and even impossible also giving rise to eventual damages in the installation. Besides these limitations this method requires a large flow of cooling fluid.

According to method (2), the cooling essentially starts from the outer surface just as in method (1), and, as a result, it has the limitation of the wall thickness of the steel tube.

The amount of cooling fluid that enters the tube at the time of dipping vaporizes, thereby forming vapour pockets that cause an uneven cooling from the inner surface. Another limitation of method (2) is that the dipping of the tube into the cooling medium occurs in an uncontrolled manner.

Finally, DE Pat 3216496 describes an installation without immersion tank, in which the cooling water can be led to both the inner and the outer surfacer the steel tube being turned while tempering.

The cooling from the outer surface occurs by the action of the laminar flow of the cooling fluid led to the tube. The internal cooling is provided by an equipment bearing an injection head. The tube is secured by one of its ends to this equipment bearing an injection head, which is provided with a plurality of auxiliary elements and is coupled to a movable base, driven by chains and pulleys, its movement being possible only horizontally in a reciprocating manner. The tube is maintained against the injection nozzle by at least one pair of fixing devices, each being made up of a plurality of drives arranged integral with the equipment itself and being complex to operate, and maintained in a horizontal position by a plurality of jointed arms linked by a drag with a single drive.

This system of the prior art presents various disadvantages.

First, this method does not warrant that the whole outer surface of the tube remains in constant contact with the cooling medium. The result is a strong reduction in the speed of the method with a significant increase in the time required for tempering the steel tubes.

Second, since the rotation of the tube is obtained by driving the head for internal cooling, the fixation end of the steel tube has to be secured firmly by the fixing system linkage. In order to ensure this fixation, beside placing the tube in the correct position, the fixation end has to be aligned and leveled with respect to the fixing device and should have even edges that is to say: just as in the case of tempering methods and installations of the prior art commented on above, this system too cannot be employed either with steel tubes having rough lamination ends or with tubes having warped ends. And even if used for tubes having even lamination edges, which renders this system really not advantageous or profitable or desirable, the section of connection with the injection nozzle still has to be positioned so as to align the nozzle axis with the centerline of the tube to be tempered.

Another drawback of this system is that, due to the fact that it has a single drive with mechanical interconnection between the jointed arms, the fixation course is the same for all the upper idler rollers, thus requiring the steel tube to have a high rectilineability. This requirement makes the temper with rotation of warped steel tubes impossible, does not ensure the fixation of the whole steel tube in the case of the temper of tubes having ends with outer projections (in the event that the position of an upper pair of fixing rollers coincides with the depressed ends, only this end, which has a larger diameter with respect to the rest of the steel tube, would be fixed).

In order to overcome the drawbacks of the methods of the prior art, the present invention relates to a system for tempering steel tubes comprising an immersion tank designed for receiving a cooling fluid, a chassi for supporting the tube to be tempered horizontally in the tank, means for displacing the chassi from a first position in which the tube is suspended above the tank to a second position in which the tube is inside the chassi, so that, in use, it does not float while being dipped into the immersion tank, and a cooling fluid injecting nozzle for injecting cooling fluid into the tube, characterized by comprising an injection nozzle support that can be actuated for abutting the nozzle with said end of the tube in said first position and to allow the injection nozzle to follow the tube to said second position of immersion in the tank.

It is another object of this invention to provide a method of tempering, by which the cooling of the outer and inner walls occurs in a substantially simultaneous manner and at a high speed, due to the fact that the dipping and the injection are effected in a substantially simultaneous manner.

A preferred embodiment of the new device for tempering steel tubes proposed by this invention will now be scribed with reference to the figures.

BRIEF DESCRIPTION OF THE DRAWINGS

FIG. 5 shows the system for fixing the steel tubes in the fixation position for large tube diameters;

FIG. 6 shows the system for fixing the steel tubes in the fixation position for small tube diameters;

FIG. 7 shows a simplified view AA of FIG. 1 indicating the chassi in the upper position, the cooling-fluid tank and the injection nozzle in the retracted position, without the tube-fixing system, the rollers for turning the movable chassi and the their drive for simplifying visualization of the device;

FIG. 8 shows the chassi with the elements of FIG. 7 in the position of immersion in the cooling-fluid tank;

In FIGS. 1 and 2, reference number 6 indicates the tank containing cooling fluid for tempering steel tubes having an usual length of about 35 meters long (intended for tempering short and long steel tubes). References 4*a*, . . . 4*n*–1, 4*n* indicate a plurality of lower pairs of rollers for supporting and turning steel tube 5, mounted on chassi 2 with a certain spacing, which are driven by a drive 8. Reference 3*a*, 3*b* . . . 3*n* indicate each of the idler rollers of the plurality of sets of the upper fixation system of steel tube 5 spaced mounted on movable chassi 2.

Figures 1, 2:
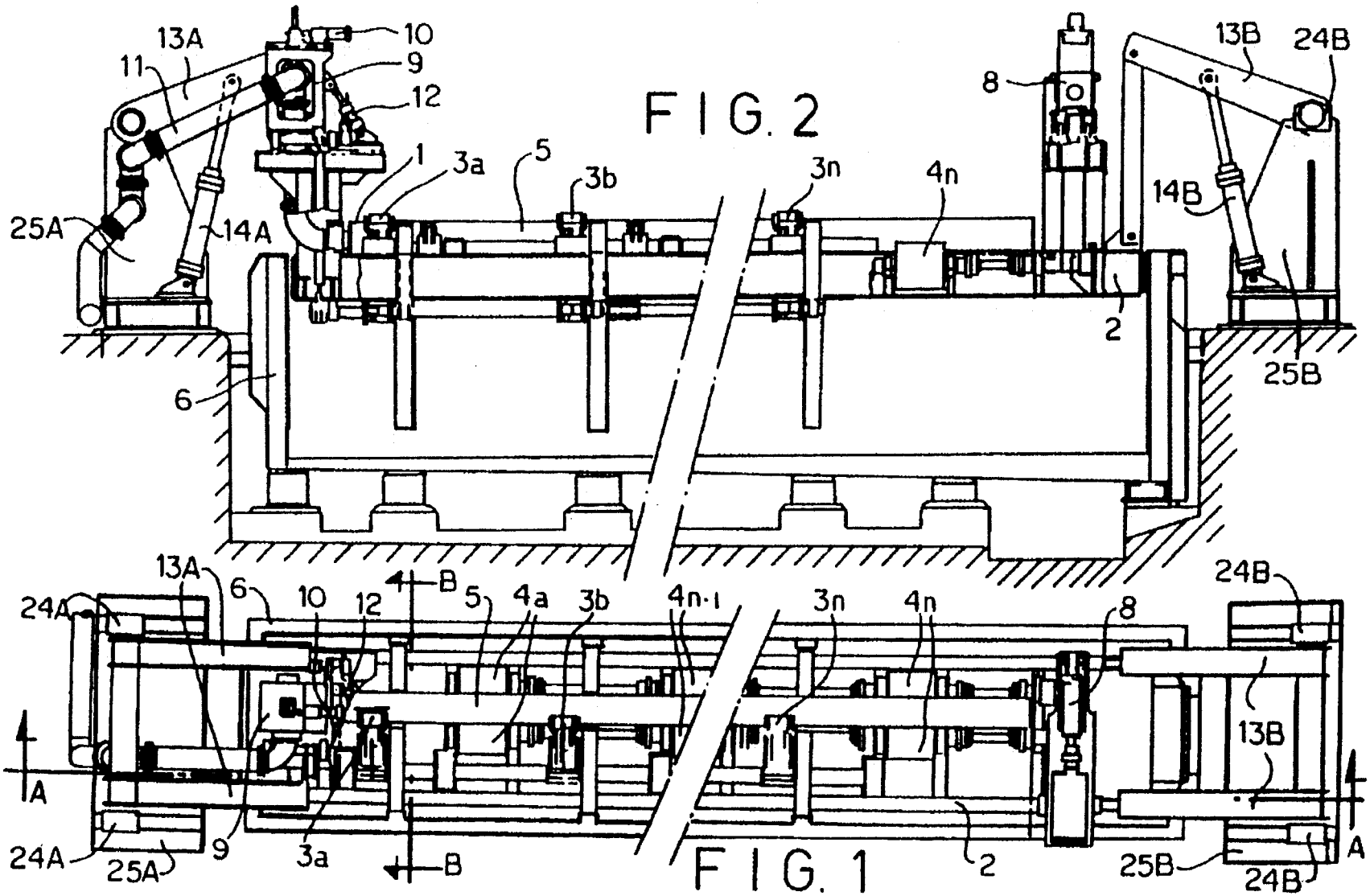
FIG. 1 shows an upper plan view of the preferred embodiment of the invention.
FIG. 2 shows a side view taken in line AA of FIG. 1.

Reference 1 indicates the injection nozzle at the end of a head 9, mounted on movable chassi 2, which has a drive system 10 for setting the height of injection nozzle 1 with respect to tube 5. The cooling fluid for internal cooling of steel tube 5 is guided into injection nozzle 1 by the portion formed by linked lines which include the set of pipes 11 jointed by rotary links. Head 9 has an angular drive mechanism 12 for introducing injection nozzle 1 into an end of steel tube 5. Movable chassi 2 is supported by a jointed mechanical system 13A and 13B, which has drive cylinders 14A and 14B for dipping movable chassi 2 into the cooling-fluid tank 6.

Figure 3:
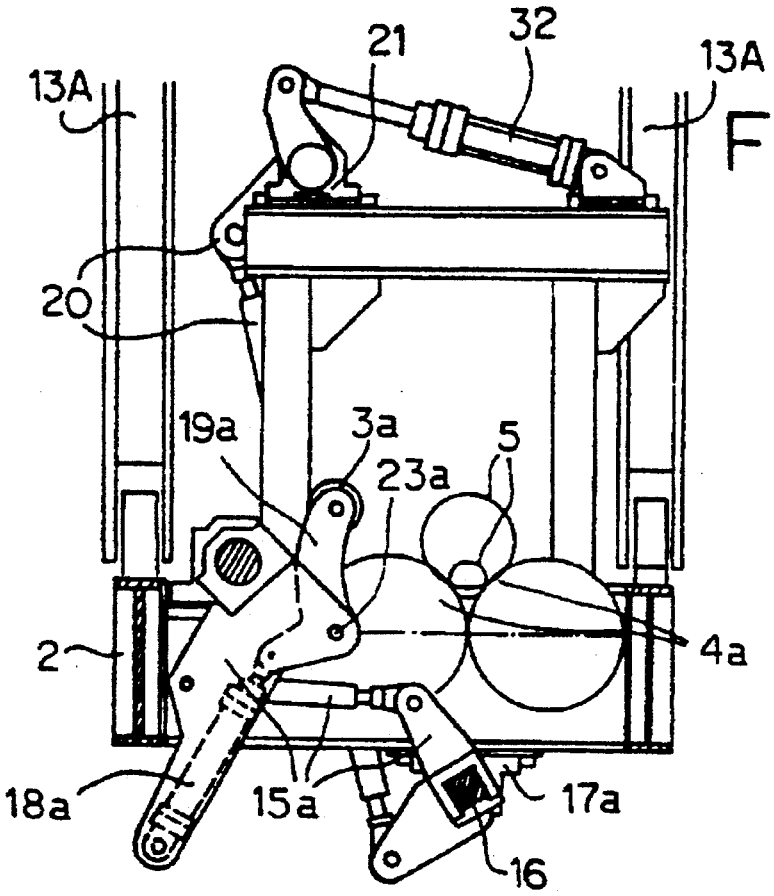
FIG. 3 shows a view taken in line BB of FIG. 1, indicating the steel tube (small and large diameter) resting upon the rollers for turning the movable chassi and the system for fixing the steel tubes in the retracted position.
Figure 4:
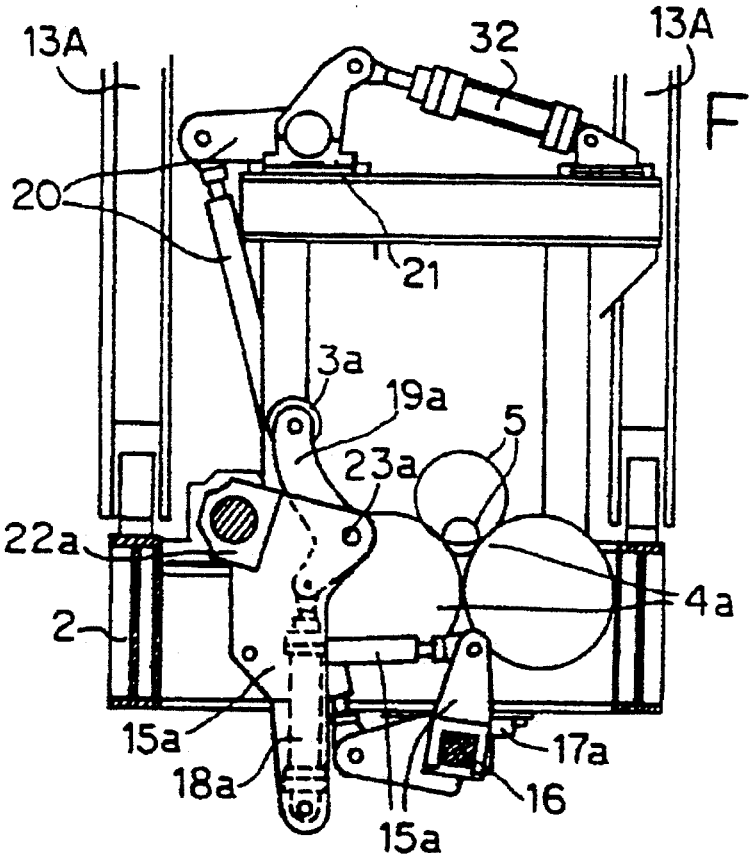
FIG. 4 shows the system for fixing the steel tubes in the advanced position.

FIGS. 3, 4, 5, and 6 illustrate one of a plurality of sets of the upper fixation system of steel tube 5 on the pairs of lower rollers 4*a*, 4*n*–1,4*n*. Reference number 32 indicates a cylinder coupled with one end of a lever system 20. Said end of the lever system 20 is pivotally joined with a bearing 21 and the other end is radially coupled with a rotary axle 16 mounted on a bearing 17*a*. Bearing 17*a* is fixed on the lower part of the movable chassi 2. Reference number 15*a* indicates a lever system with one end pivotally mounted on bearing 22*a* and the other end coupled with axle 16. The lever system 15*a* has a linked arm 19*a* coupled with an idler roller 3*a* mounted at the free end. The lever system 15*a* leads the idler roller 3*a* from a retracted position to an advanced position, as shown in FIGS. 3 and 4. Actuator 32, lever system 20 and axle 16 are unique and they simultaneously actuate all the assemblies of the upper fixation system of the steel tubes. Reference number 18*a* indicates an individual displacement cylinder of idler roller 3*a*, mounted on the linked arm 19*a* pivoted at point 23*a*.

In FIGS. 7 and 8 reference number 6 indicates the tank containing cooling fluid, the movable chassi 2 and the steel tube 5 in the positions out of the cooling fluid (FIG. 7) and dipped into the cooling fluid (FIG. 8), and the head 9 for internal cooling of the tube, having at its base the injection nozzle 1 connected with the pipe run of the pipe assembly 11 with rotary joints and respective drive devices for manoeuvre. (The fixation systems of the tubes 5, the lower support and turn pairs of rollers 4*a*, . . . 4*n*–1 of movable chassi 2 and drive 8 thereof have not been indicated in FIGS. 7 and 8, for a better visualization of the system).

Movable chassi 2 is supported by a linked mechanical system 13A and 13B, which has drive cylinders 14A and 14B for dipping the movable chassi 2 into the cooling-fluid tank 6 and its later recovery. The linked mechanical systems 13A and 13B are pivotally mounted on bearings 24A and 24B on pedestals 25A and 25B.

Figure 9:
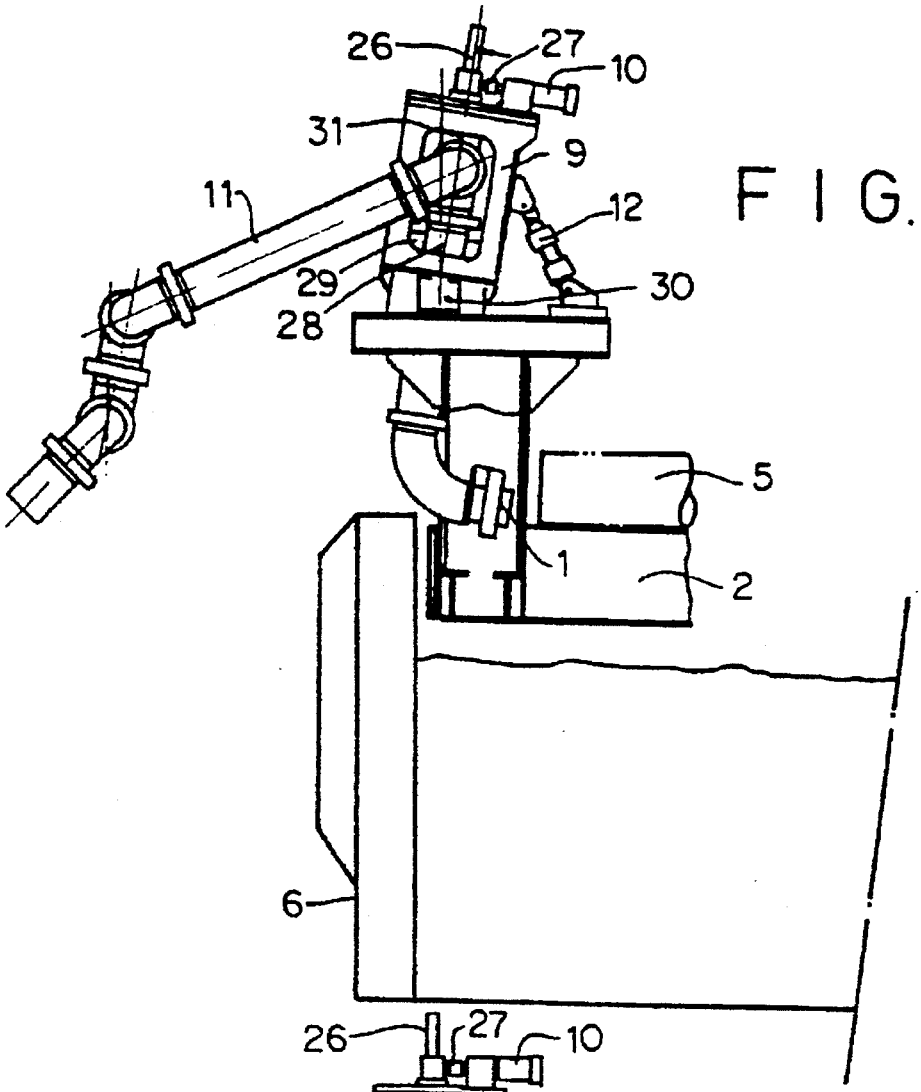
FIG. 9 shows in detail the head of FIGS. 7 and 8 for internal cooling mounted on the movable chassi in the retracted position and out of the cooling fluid.
Figure 10:
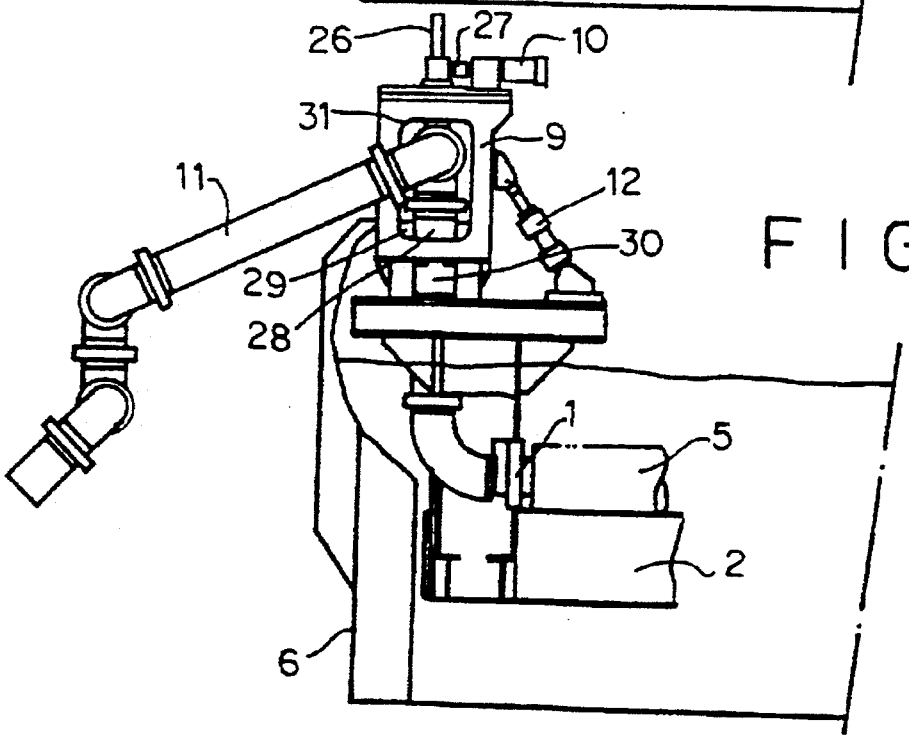
FIG. 10 shows the detail of the head for internal cooling mounted on the movable chassi, in the advanced position and dipped into the cooling fluid.

FIGS. 9 and 10 show an enlarged view of the immersion assembly comprising head 9, injection nozzle 1 and movable chassi 2 for internal cooling of steel tube 5, in respective positions suspended above (FIG. 9) and dipped into the cooling fluid (FIG. 10). Head 9 is pivotally mounted on a pedestal joined to movable chassi 2 and bearing an injection nozzle 1 on the lower side of the pedestal for abutting one end of pipe 5 and enabling a fluid communication with the pipe assembly 11.

Reference number 10 illustrates the drive of the height adjusting system of injection nozzle 1 with respect to steel tube 5. The drive 10 is coupled with a spindle 26 by elastic coupling 27. The end of the spindle 26 is secured to the internal pipe 28 of head 9 by connection 31. The inner pipe 28 is guided by guides 29 of head 9, which permit the vertical displacement of internal pipe 28 to follow the vertical displacement of injection nozzle 1. Internal pipe 28 is connected at its upper end to the piping assembly 11 by means of rotary joints.

Reference number 12 indicates a drive cylinder which is the positioning means for the angular displacement of head 9 therefore enabling the introduction of injection nozzle 1 into one end of the steel tube 5.

Based on these definitions the operation of the installation in accordance with the invention will be described.

Before the start of the operation the height of the injection nozzle 1 is adjusted considering the position of the steel tube 5, supported by the lower pairs of rollers 4*a*, . . . 4*n*–1, 4*n*, mounted on the movable chassi 2 with a certain spacing. This setting is effected by adjusting the drive 10 in either clockwise or counterclockwise direction which through coupling 27 will advance or retract spindle 26. Spindle 26 is connected at one end to a straight internal pipe 28 located at head 9 by means of connection 31 therefore enabling the vertical displacement of pipe 28 with the aid of guides 29. Since injection nozzle 1 is coupled to the lower end of the internal pipe 28, it will displace in vertical direction upwards and downwards, depending upon the turning of the drive 10. The pipe assembly 11 with rotary joints connected at the upper end of the internal pipe 28 follows the vertical displacement thereof.

The steel tubes 5 are heated up to austenitization temperature or above and transported individually to their position on the rotary lower support rollers 4*a* . . . 4*n*–1, 4*n*, mounted on movable chassi 2 with a certain spacing, as indicated in FIG. 1.

The form of transportation of the steel tubes 5 (not shown in FIG. 1) can be both longitudinal and transverse, by employing the usual systems for transportation of the steel tubes in production lines, although it is necessary to ensure that one of the ends of the steel tube 5 remains in a position that permits the introduction of the injection nozzle 1 therein after the angular displacement of head 9. Afterwards, the cylinder actuator 32 is impelled as shown in FIGS. 3 and 4, turning axle 16 through the lever system 20 consequently moving the lever system 15*a*, 15*b* . . . 15*n* and therefore placing idler rollers 3*a*, 3*b* . . . disposed on the sets of the upper fixation system of steel tubes 5 in the advanced position, as shown in FIG. 4.

The advanced position of idler rollers 3*a*, 3*b* . . . 3*n* of the upper fixation system of the steel tube 5 is adjustable, in accordance with the diameter of the steel tube to be fixed, by means of a fluid actuator such as hydraulic cylinder 32. Cylinders 18*a*, 18*b* . . . 18*n* are then actuated, individually turning arms 19*a*, 19*b* . . . 19*n* until the idler roller 3*a*, 3*b* . . . 3*n* rest on the upper surface of the steel tube 5, with a constant and regulable fixation force by varying the pressure on cylinders 18*a*, 18*b* . . . 18*n*, as shown in FIGS. 5 and 6. Since each set of the upper fixation system of the steel tube has a single actuator cylinder 18*n*, the respective idler roller 3*n* is individually displaced in until it abuts the surface of the steel tube 5. Considering also that the fixation force is constant, the upper fixation system of the steel tube 5 of this invention ensures the fixation along the whole steel tube, even for steel tubes having depressed and/or warped ends, with or without rotation thereof. Simultaneously with the fixation of the steel tube 5, or with a minor time lag, the lower pairs of rollers 4*a*, 4*n*–1, 4*n*, are driven in rotation to transmit a rotary movement to the steel tube 5 supported thereon. The rotation speed of the lower pairs of rollers 4*a*, . . . 4*n*–1, 4*n* is adjustable (to provide the desired rotation speed of the steel tube 5) through a conventional command system, actuating on drive 8, which permits optimum selection of the speed of rotation taking into account the degree of warping and the diameter of steel tube 5, as shown in FIGS. 1 and 2.

Simultaneously with the fixation of the tube 5 or with a minor time lag cylinder 12 is actuated causing an angular displacement of head 9, pivotally mounted on bearing pair 30. This displacement guides the injection nozzle 1, fixed at the lower end of internal pipe 28, into the tube 5 which is already supported on the lower pairs of rollers 4*a*, . . . 4*n*–1, 4*n*. The system of cooling from the inner surface of the steel tube according to the present invention has the advantage that it does not need a coupling between the injection nozzle 1 and the end of the steel tube 5, the injection nozzle 1 being only introduced into the end of the tube 5, permitting tempering of tubes having a rough lamination end and/or non-excessive warping.

After the introduction of the injection nozzle 1 into one end of tube 5 which is fixed by the idler rollers 3*a*,3*b* . . . 3*n* and supported and rotated by the lower pairs of rollers 4*a*, . . . 4*n*–1, the cylinders 14A and 14B are actuated, moving the linked mechanical systems 13A and 13B pivotally mounted on bearings 24A and 24B on supports 25A and 25B thus dipping the movable chassi 2 together with the tube 5 in the tank 6 containing cooling fluid for cooling from the outer surface of the tube. Simultaneously with the immersion of the tube 5 into the tank 6 containing cooling fluid or with a minor time lag, cooling fluid is directed through the pipe assembly 11 with rotary joints towards the injection nozzle 1, providing a flow injection of cooling fluid internally and along the tube 5, thereby enabling simultaneous cooling from the inner surface of the tube, as shown in FIGS. 7 and 8. After completion of a certain cooling period of the inner and outer surfaces of the tube 5, the flow of water through the injection nozzle 1 is interrupted and the cylinders 14A and 14B are actuated to lift the movable chassi 2. Cylinder 12 displaces head 9 and retracts the injection nozzle 1 from the end of the tube 5. Cylinders 18*a*, 18*b*, 18*n* are actuated to liberate the pressure applied to tube 5 by idler rollers 3*a* . . . 3*n* and cylinder 32 is then actuated to displace the idler rollers to their retracted position. Drive 8 being turned off, rotation of the lower pairs of rollers 4*a*. . . 4*n* is stopped and the whole system returns to its initial configuration, permitting the steel tube to be removed and releasing the installation for tempering the next tube. The flow of cooling fluid in the tank 6 is effected through a conventional pumping and cooling system, maintaining the cooling fluid temperature in the tank 6 constant during the process.

Although the tempering device of the embodiment described is designed for cooling from the inner and outer surfaces of the steel tube, this invention can be employed for cooling only from the inner surface without dipping the tube into the cooling fluid, or for cooling from the inner and outer surfaces by dipping the tube partly into the cooling fluid, or for cooling only from the outer surface by dipping the tube either totally or partly into the cooling fluid.

The tempering device of the present invention provides the following benefits and innovations to the method of tempering steel tubes:

1) The installation can be integrated with the direct manufacture flow, employing now steel tubes having rough lamination ends, without reducing the production capacity of the plant, due to the high cooling speeds obtained with the method, and continuous production flow;

2) Due to the fixation system with individually actuated idler rollers with setting and fixation by constant pressure hence ensuring the fixation of the tube and preventing it from floating, it is now possible to temper those steel tubes presenting depressed ends and relative warps which can not be tempered on tempering facilities of the known art.

3) The height adjusting system of the injection nozzle with respect to the steel tube is of simple conception, enabling settings even during the operation of the installation;

4) The injection nozzle is dipped into the cooling fluid together with the steel tube, thus enabling at the start of the process a simultaneous cooling from the inner and outer surfaces of the steel tube therefore obtaining high cooling speeds.

We claim:

1. A device for tempering steel tubes comprising an immersion tank for receiving a cooling fluid, a chassis for supporting horizontally a tube to be tempered in the tank, displacement means for displacing the chassis from a first position in which the tube is suspended above the tank to a second position in which said tube is inside the tank, a first plurality of lower pairs of rollers for supporting and turning said tube, a second plurality of idler rollers substantially opposite to said lower pairs of rollers, roller positioning means for moving said idler rollers to and from positions where they maintain said tube on the chassis so that the tube will not float while being dipped into the immersion tank, a cooling fluid injection nozzle adaptable to an end of the tube to be tempered for injection of cooling fluid into the tube, a head for supporting said injection nozzle, said head including nozzle positioning means for inserting said injection nozzle in and retracting said injection nozzle from an end of the tube, said nozzle positioning means also being operable to raise and lower the injection nozzle with respect to the centerline of said tube.

2. A device in accordance with claim 1 including a pedestal, said head being pivotally mounted on said pedestal, and a leg which joins said pedestal to said chassis.

3. A device in accordance with claim 2 having linked lines and a straight pipe for supplying cooling fluid to the injection nozzle, said linked lines being connected to said head, said straight pipe being arranged for displacements which follow displacements of said injection nozzle.

4. A device in accordance with claim 1 wherein the nozzle positioning means includes a single fluid actuator device for inserting the injection nozzle in and retracting the injection nozzle from an end of the tube.

5. A device in accordance with claim 1 having a straight pipe mounted on the head for supplying cooling fluid to the injection nozzle, said head being pivotable and having guides for guiding vertical movements of said straight pipe on said head, said nozzle positioning means including a spindle and an elastic coupling for producing said vertical movements.

6. A device in accordance with claim 1 wherein said roller positioning means includes a plurality of arms supported by pivot bearings, each of said arms having a first end which supports at least one of said idler rollers, each of said arms having a second end, a plurality of actuators each of which is connected to a second end of one of said arms to force a respective idler roller against said tube even when a tube has depressed or warped portions.

7. A device in accordance with claim 6 wherein said roller positioning means includes a single motion transmitter which is operable to simultaneously displace said plurality of actuators which apply forces against the tube.

* * * * *